United States Patent [19]

Baldwin

[11] Patent Number: 4,979,710

[45] Date of Patent: Dec. 25, 1990

[54] TRAY ACCESSORY APPARATUS FOR LADDERS

[76] Inventor: Donald W. Baldwin, Rte. 4, Box 131-A, Leland, N.C. 28451

[21] Appl. No.: 347,628

[22] Filed: May 5, 1989

[51] Int. Cl.[5] ..... E06C 7/14

[52] U.S. Cl. ..... 248/210

[58] Field of Search ..... 248/210, 211, 238, 311.2, 248/314, 315, 312.1; 182/129, 122

[56] References Cited

U.S. PATENT DOCUMENTS

| | | | |
|---|---|---|---|
| 2,710,129 | 6/1955 | Telech | 248/238 X |
| 2,883,134 | 4/1959 | O'Halloran | 248/210 |
| 3,154,282 | 10/1964 | Monson | 248/211 |
| 3,840,204 | 10/1974 | Thomas et al. | 248/311.2 |
| 3,842,981 | 10/1974 | Lambert | 248/311.2 X |
| 3,940,824 | 3/1976 | Gioia et al. | 15/257.06 |
| 4,025,016 | 5/1977 | Brothers | 248/210 |
| 4,222,541 | 9/1980 | Chillis | 248/210 |
| 4,534,528 | 8/1985 | Rousseau | 248/210 |
| 4,560,127 | 12/1985 | Ippolito | 248/210 |

FOREIGN PATENT DOCUMENTS

| | | | |
|---|---|---|---|
| 495310 | 4/1930 | Fed. Rep. of Germany | 248/315 |

*Primary Examiner*—Alvin C. Chin-Shue

*Attorney, Agent, or Firm*—Henderson & Sturm

[57] ABSTRACT

A tray accessory apparatus (10) for use in different orientations relative to a ladder (100) wherein the apparatus (10) comprises a main bracket support unit (11) that can be suspended from the rungs (102) of a ladder (100) by support arms (23); a locking unit (12) operably associated with the support arms (23) for frictionally grasping a selected rung (102); and a tray unit (13) operatively associated with the main bracket support unit (11) whereby the tray unit (13) may be disposed in a variety of orientations relative to the main bracket support unit (11).

7 Claims, 2 Drawing Sheets

FIG. 1.
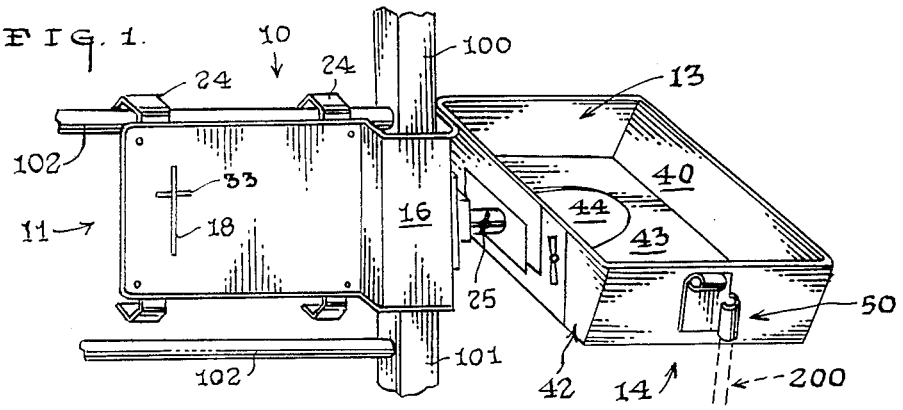
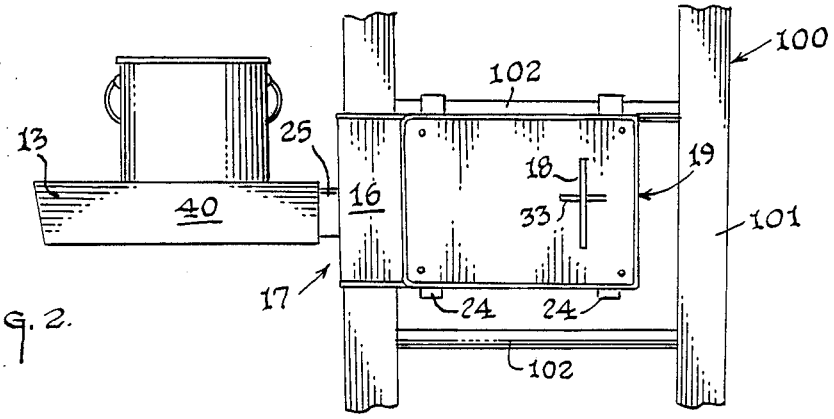
FIG. 2.
FIG. 3.
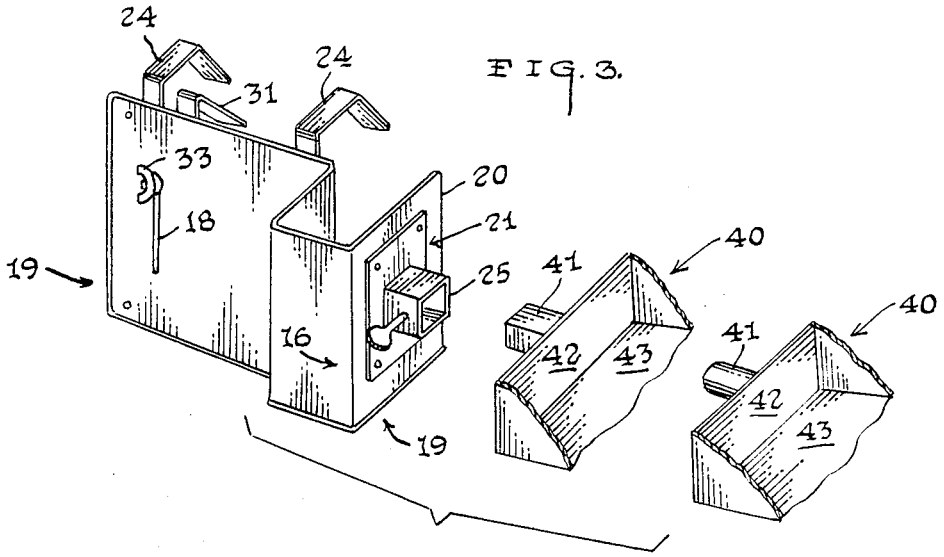

FIG. 4.
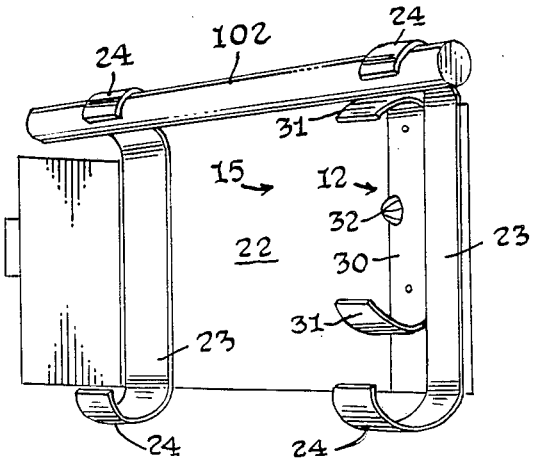
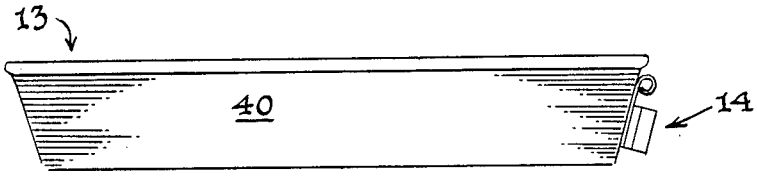
FIG. 6.
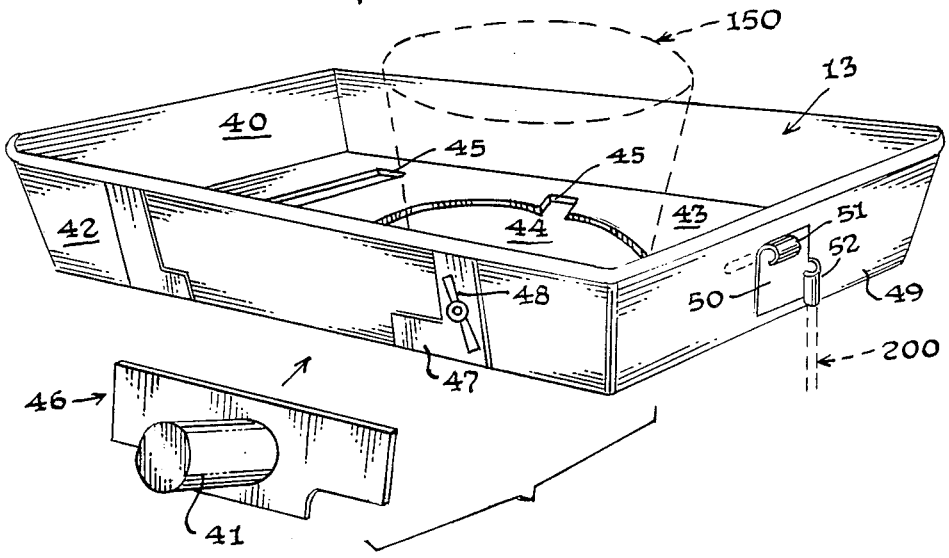
FIG. 5.

TRAY ACCESSORY APPARATUS FOR LADDERS

TECHNICAL FIELD

The present invention relates generally to a support accessory for attachment to a ladder, and in particular, to a ladder support accessory with means to facilitate the removable attachment of a tray member as well as other diverse other items.

BACKGROUND OF THE INVENTION

This invention was the subject matter of Document Disclosure Pro gram Registration No. 181607 which was filed in the U.S. Patent and Trademark Office on Nov. 23, 1987.

As can be seen by reference to the following U.S. Pat. No's.: 4,560,127; 4,222,541; 4,025,016; and 3,940,824, the prior art is replete with myriad and diverse accessory support devices for attachment to ladders.

While the aforementioned prior art constructions are more than adequate for the basic purpose and function for which they were specifically designed, these devices are also uniformly deficient in their locking and orientation dispositions relative to a ladder, as well as their failure to provide auxiliary support brackets on the main support structures to accommodate and support other diverse implements.

As a consequence of the foregoing situation there has existed a longstanding need among users of this type of a device for a versatile tray support apparatus that may be selectively installed on either the right or left hand side of an extension ladder or the like; wherein, the support apparatus includes an adjustable locking mechanism adapted accommodate different ladder rung configurations, as well as at least one auxiliary bracket to operatively engage implements such as a caulk gun or the like; and, the provision of such a support apparatus is a stated objective of the present invention.

SUMMARY OF THE INVENTION

Briefly stated, the tray accessory apparatus that forms the basis of the present invention comprises a main bracket support unit, a bracket locking unit, a tray unit, and an auxiliary bracket support unit.

The main bracket support unit comprises in general: a bracket support plate member having a plurality of support arms projecting from both the top and bottom portions of the bracket support plate member. In addition, the bracket support plate member is further provided with a tubular mounting member, which projects outwardly from one side of the bracket support plate member wherein the tubular mounting member is adapted to receive the tray unit.

The bracket locking unit comprises a locking arm member which is adjustably and operably engaged with the rear face of the bracket support plate member, wherein the locking arm member is adapted to selectively cooperate with the support arms on the top and bottom of the bracket support plate member to orient the tubular mounting member on opposite sides of a ladder.

The tray unit comprises in general: a tray member having a tubular adapter element that is dimensioned to be received in various orientations relative to the tubular mounting member of the main bracket support unit.

The auxiliary bracket support unit comprises at least one auxiliary bracket member adapted to releasably engage an implement such as a caulk gun or the like.

BRIEF DESCRIPTION OF THE DRAWINGS

These and other objects, advantages and novel features of the invention will become apparent from the detailed description of the best mode for carrying out the preferred embodiment of the invention; particularly when considered in conjunction with the accompanying drawings, wherein:

FIG. 1 is a perspective view of the tray accessory apparatus mounted on the right side of a ladder;

FIG. 2 is a front plan view of the tray accessory apparatus mounted on the left side of the ladder;

FIG. 3 is an isolated exploded perspective view of the main bracket support unit and a portion of the tray unit;

FIG. 4 is an isolated perspective view of the cooperation of the bracket locking unit with one of the rungs of a ladder;

FIG. 5 is an exploded perspective view of an alternate version of the tray unit; and, FIG. 6 is a side plan view showing an implement releasably engaged by the auxiliary bracket support unit.

BEST MODE FOR CARRYING OUT THE INVENTION

As can be seen by reference to the drawings and in particular to FIG. 1, the tray accessory apparatus that forms the basis of the present invention is designated generally by the reference numeral (10). The apparatus (10) comprises in general: a main bracket support unit (11); a bracket locking unit (12); a tray unit [13); and, an auxiliary bracket support unit (14). These units will now be described in seriatim fashion.

As shown in FIGS. 1 thru 4, the main bracket support unit (11) comprises a generally rectangular main bracket body member (15) having a generally C-shaped vertically disposed extension member (16) formed on one side (17) and an elongated vertical aperture (18) formed proximate the other side (19).

As can best be seen by reference to FIGS. 1 thru 3, the generally C-shaped vertically disposed extension member (16) is dimensioned to receive either vertical leg (101) of a ladder (100); wherein, the outboard end (20) of the extension member (16) is provided with a mounting collar element (21) whose purpose and function will be described in greater detail further on in the specification.

As can best be seen by reference to FIG. 4, the rear face (22) of the generally rectangular main bracket body member (15) is provided with a plurality elongated arm members (23) having hook elements (24) formed on their opposite ends; wherein, the hook elements (24) project beyond the upper and lower portions of the main bracket body member (15) and wherein the hook elements (24) are dimensioned to receive the rungs (102) of a ladder (100)

Still referring to FIG. 4, it can be seen that the bracket locking unit (12) comprises a locking arm member (30) having outwardly projecting locking elements (31) formed on the upper and lower ends of the locking arm members (30); wherein, the locking arm member (30) is operatively and movably engaged to the main bracket body member (15) by a fastening member (32). The fastening member (32) is fixedly connected on one end to the locking arm member (30); wherein the free end of the fastening member (32) is dimensioned to be received in the elongated aperture (18) of the main bracket body member (15) and be engaged by a releasable securing member (33) in a well recognized fashion.

Turning back to FIGS. 1 and 2, it can be appreciated that the main bracket support unit (11) can be oriented on either the left side or the right side of a ladder by loosening the bracket locking unit (12) and rotating the main bracket support unit (11) 180° in the vertical plane; whereupon, the bracket locking unit (12) would be moved upwardly into engagement with the supporting rung (102) of the ladder to dispose the mounting collar (21) on opposite sides of the ladder (100).

As shown in FIG. 3, the mounting collar element (21) comprises a hollow tubular mounting member (25) which projects outwardly from the outboard end (20) of the extension member (16) wherein the hollow tubular mounting member (25) is provided with a threaded fastener (26) whose purpose will be described presently.

As can be seen by reference to FIGS. 1, 2, 5 and 6, the tray unit (13) comprises in general: a tray member (40) having an outwardly projecting tubular extension (41) operatively secured on one of the sides (42) of the tray member (40); wherein, the tubular extension (41) is dimensioned to be slideably received in the hollow tubular mounting member (25), and releasably engaged by the threaded fastener (26), to operatively engage the tray unit (13) to the main bracket support unit (11).

In addition, the base (43) of the tray member (40) is further provided with a central recess (44) and a plurality of depressions (45) wherein the central recess is dimensioned to receive and retain a receptacle (150) (shown in phantom), such as a paint can or the like; and the depressions (45) are dimensioned to accommodate the other units that comprise the apparatus (10 in the storage mode.

In one version of the preferred embodiment depicted in FIGS. 1 and 3, both the hollow tubular mounting member (25) and the tubular extension (41) of the tray unit (11) are provided with a generally square configuration, wherein there are a limited number of different orientations permissable between the hollow tubular mounting member (25) and the tubular extension (41).

In the other version of the preferred embodiment illustrated in FIGS. 2 and 5, both the hollow tubular mounting member (25) and the tubular extension (41) of the tray unit are provided with a generally cylindrical configuration; wherein, the hollow tubular mounting member (25) and the tubular extension (41) may be rotated 360° relative to one another.

As can also be seen by reference to FIG. 5, the second version of the preferred embodiment also contemplates having the tubular extension (41) fabricated on a plate element (42) releasably disposed relative to the tray member (40); wherein, the plate element (46) is dimensioned to be received in a bracket (47) having a locking means (48) whereby the tubular extension (41) and plate element (46) may be selectively engaged and disengaged with the tray member (40).

As can best be seen by reference to FIGS. 1 and 5, the auxiliary bracket support unit (14) comprises an auxiliary bracket member (50) mounted on one of the sides (49) of the tray member (40); wherein, the auxiliary bracket member (50) includes a generally cylindrical capture element (51) horizontally disposed on the upper portion of the auxiliary bracket member (50). In addition, the auxiliary bracket member (50) further comprises a generally C-shaped retention element (52) vertically disposed along one edge of the auxiliary bracket member (50); wherein, the retention element (52) is laterally spaced relative to the capture element (51) such that the auxiliary bracket member (50) may releasabley engage and suspend the L-shaped handle (200) of a caulking gun or the like, depicted in phantom.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A tray accessory apparatus for ladders having a pair of vertical legs and a plurality of rungs wherein the tray accessory apparatus comprises:

a main bracket support unit including: a main bracket body member having upper and lower portions and equipped with a plurality of elongated arm members having hook elements formed on their opposite ends; wherein, the hook elements project beyond the upper and lower portion of the main bracket body member to receive the rungs of said ladder; an extension member formed on one end of the main bracket body member wherein the extension member is provided with an outboard end and is dimensioned to receive both of the vertical legs of the ladder in different orientations of the main bracket support unit; and, a mounting collar element mounted on the outboard end of the extension member where the mounting collar element includes a hollow tubular mounting element;

a tray unit including a tray member having an outwardly projecting tubular extension operably secured on one of the sides of the tray member wherein the outwardly projecting tubular extension is dimensioned to be received in a variety of orientations relative to the said hollow tubular mounting element of the main bracket support unit; and, said tray accessory apparatus further comprising:

a bracket locking unit including a locking arm member having upper and lower ends operably and movably attached to the main bracket body member wherein the locking arm member is provided with outwardly projecting locking elements formed on the upper and lower ends of the locking arm member; wherein, the locking arm member may be moved relative to the main bracket body member to bring a selected one of the locking elements into engagement with a rung on the ladder depending on the desired orientation of the main bracket support unit relative to said ladder.

2. The tray accessory apparatus as in claim 1 further comprising:

an auxiliary bracket support unit operatively associated with the tray unit wherein the auxiliary bracket support unit comprises an auxiliary bracket member secured to one of the sides of the tray member and having a generally cylindrical capture element horizontally disposed on the auxiliary bracket member.

3. The tray accessory apparatus as in claim 2 wherein said auxiliary bracket support unit further comprises:

a retention element vertically disposed on the auxiliary bracket member.

4. The tray accessory apparatus as in claim 3 wherein the retention element has a generally C-shaped configuration and is laterally spaced relative to the capture element.

5. The tray accessory apparatus as in claim 1 wherein both the outwardly projecting tubular extension and the hollow tubular mounting element have a generally square configuration.

6. The tray accessory apparatus as in claim 1 wherein both the outwardly projecting tubular extension and the hollow tubular mounting element have a generally cylindrical configuration.

7. The tray accessory apparatus as in claim 1 wherein the outwardly projecting tubular extension has a generally square configuration and the tubular mounting element has a generally cylindrical configuration.

* * * * *